US010583895B2

(12) United States Patent
Haller et al.

(10) Patent No.: US 10,583,895 B2
(45) Date of Patent: Mar. 10, 2020

(54) HYBRID FRAME BOAT WITH DROP-SWITCH BLADDERS

(71) Applicant: Advanced Elements, Inc., Benicia, CA (US)

(72) Inventors: Clayton F. Haller, Concord, CA (US); Charles P. Hall, Bainbridge, WA (US); Ryan Pugh, Martinez, CA (US)

(73) Assignee: ADVANCED ELEMENTS, INC., Benicia, CA (US)

( * ) Notice: Subject to any disclaimer, the term of this patent is extended or adjusted under 35 U.S.C. 154(b) by 0 days.

(21) Appl. No.: 15/905,601

(22) Filed: Feb. 26, 2018

(65) Prior Publication Data

US 2019/0263476 A1 Aug. 29, 2019

(51) Int. Cl.

| | |
|---|---|
| ***B63B 7/08*** | (2020.01) |
| ***B63B 3/26*** | (2006.01) |
| ***B63B 35/71*** | (2006.01) |

(52) U.S. Cl.

CPC ..... *B63B 7/082* (2013.01); *B63B 3/26* (2013.01); *B63B 35/71* (2013.01)

(58) Field of Classification Search

CPC ..... B63B 2007/065; B63B 7/08; B63B 7/082; B63B 7/085

See application file for complete search history.

(56) References Cited

U.S. PATENT DOCUMENTS

| | | | | |
|---|---|---|---|---|
| 1,736,155 | A | 11/1929 | Harter | |
| 4,751,889 | A | 6/1988 | Pool | |
| 5,964,178 | A | 10/1999 | Gonda | |
| 6,314,904 | B1 | 11/2001 | Elvestad | |
| 6,353,969 | B1 | 3/2002 | LeMole | |
| 6,371,042 | B1 | 4/2002 | Abernethy et al. | |
| 6,539,889 | B2 * | 4/2003 | Simpson | B63B 7/082 114/345 |
| 7,021,233 | B2 | 4/2006 | Hall et al. | |
| 8,082,871 | B2 * | 12/2011 | Czarnowski | B63B 35/71 114/345 |
| 8,091,502 | B2 | 1/2012 | Haller | |
| 8,438,986 | B2 | 5/2013 | Haller et al. | |
| 2006/0075955 | A1 * | 4/2006 | DeChant | B63B 7/085 114/345 |

* cited by examiner

*Primary Examiner* — Andrew Polay

(74) *Attorney, Agent, or Firm* — Lowe Graham Jones PLLC

(57) ABSTRACT

Embodiments are directed to a hybrid frame boat. The hybrid frame boat may include a cover and a drop-stitch port bladder, a drop-stitch starboard bladder, and a keel beam that may each couple to the cover. The cover may have an aft end portion, a forward end portion, a port side, a starboard side, a longitudinal length extending from the aft end portion to the forward end portion. The drop-stitch port bladder may extend along one or more portions of the port side of the cover. The drop-stitch starboard bladder may extend along one or more portions of the starboard side of the cover. The keel beam may extend along one or more portions of the longitudinal length of the cover between the drop-stitch port bladder and the drop-stitch starboard bladder.

20 Claims, 7 Drawing Sheets

HYBRID FRAME BOAT WITH DROP-SWITCH BLADDERS

FIELD OF THE INVENTION

The present invention relates generally to hybrid frame boats and, more particularly, yet not exclusively, to hybrid frame boats with drop-stitch bladders.

BACKGROUND OF THE INVENTION

Inflatable boats, such as those available under the mark ZODIAC, often have sides and a bow made from inflatable tubes that are integral to each other. These inflatable boats typically have flexible, non-reinforced floors for boats under approximately nine feet or have rigid floors (for example, plywood sheets, aluminum sheets, or others) for boats over approximately nine feet. These inflatable boats with flexible floors typically have flat hull bottoms, providing rough rides and poor tracking. These inflatable boats with rigid floors typically maintain their footprint when the tubes are deflated, preventing convenient transporting of the boats.

Inflatable boats that employ drop-stitch bladders, such as those available under the mark SEA EAGLE, typically have sides and floors made from drop-stitch bladders that are integral to each other. The drop-stitch floor bladder of these inflatable boats can be prone to puncture. Moreover, these inflatable boats and the inflatable boats described in the immediately preceding paragraph typically require replacement of the entire boat when one of the inflatable portions fails. Thus, it is with regard to these considerations and others that the present invention has been made.

BRIEF DESCRIPTION OF THE DRAWINGS

Non-limiting and non-exhaustive embodiments of the present innovations are described with reference to the following drawings. In the drawings, like reference numerals refer to like parts throughout the various figures unless otherwise specified. For a better understanding of the described innovations, reference will be made to the following Detailed Description of the Various Embodiments, which is to be read in association with the accompanying drawings, wherein.

DETAILED DESCRIPTION OF THE VARIOUS EMBODIMENTS

The various embodiments now will be described more fully hereinafter with reference to the accompanying drawings, which form a part hereof and show, by way of illustration, specific example embodiments by which the invention may be practiced. The embodiments may, however, be embodied in many different forms and should not be construed as limited to the embodiments set forth herein; rather, these embodiments are provided so that this disclosure will be thorough and complete and will fully convey the scope of the embodiments to those skilled in the art. Among other things, the various embodiments may be methods, systems, or devices. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, the meaning of "a," "an," and "the" include plural references. Also, plural references are intended to also disclose the singular, unless the context clearly dictates otherwise. The meaning of "in" includes "in" and "on." Also, the use of "when" and "responsive to" do not imply that associated resultant actions are required to occur immediately or within a particular time period. Instead, they are used herein to indicate actions that may occur or be performed in response to one or more conditions being met, unless the context clearly dictates otherwise.

Figure 1:
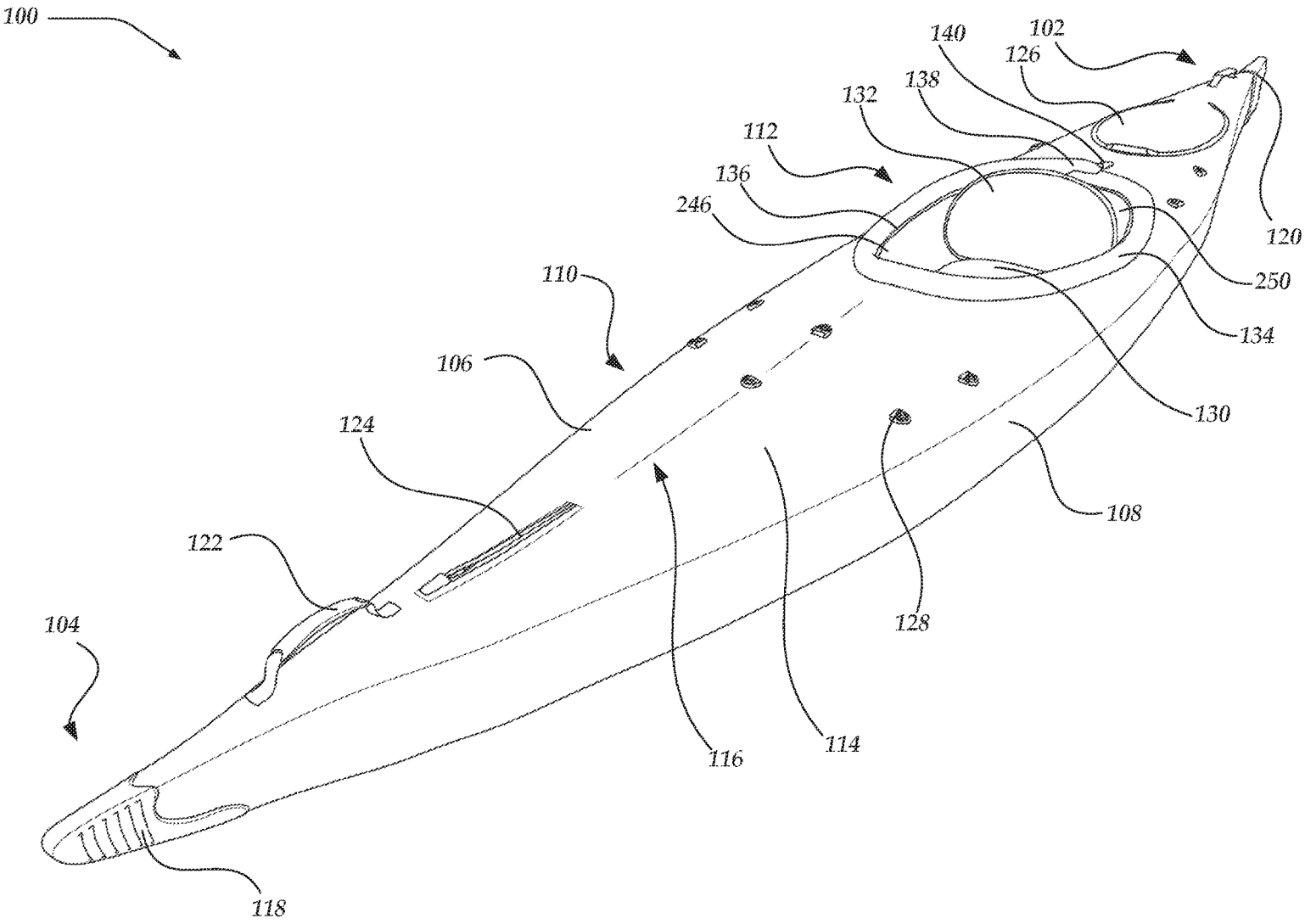
FIG. 1 illustrates a perspective front-left view of an example boat having a hybrid frame and a cover over the hybrid frame.

FIG. 1 illustrates a perspective front-left view of example boat 100. Boat 100 has aft end portion 102, forward end portion 104, a longitudinal length that extends from aft end portion 102 to forward end portion 104, a hybrid frame (see FIGS. 2-4) that extends along the longitudinal length, cover 106 (having a longitudinal length 107 as best seen in FIG. 3) disposed over the hybrid frame, port side wall 108 (having a longitudinal contour 109A that has one or more portions, such as portion 111A between the lines that are transverse to the longitudinal contour 109A, that are transverse to the longitudinal length 107 of the cover 106 as best seen in FIG. 3), starboard side wall 110 (having a longitudinal contour 109B that has one or more portions, such as portion 111B between the lines that are transverse to the longitudinal contour 109B, that are transverse to the longitudinal length 107 of the cover 106 as best seen in FIG. 3), and one or more cockpits 112 disposed between side walls 108, 110. Cover 106 extends along each of side walls 108, 110 from the bottom of boat 100 to the top of boat 100. In the example shown in FIG. 1, cover 106 extends across boat 100 from port side wall 108 to starboard side wall 110, both at the top and the bottom of boat 100. Accordingly, the top surface of the top portion of cover 106 defines deck 114 of boat 100 that extends aft, forward, port side, and starboard side of cockpit 108. In some examples, deck 114 has ridge 116 that extends along one or more portions of the longitudinal length of boat 100, thereby facilitating shedding water off deck 114.

In the example shown in FIG. 1, boat 100 is a decked boat (for example, a kayak). In other examples, cover 106 may extend only partially inward from side walls 108, 110 at the top of boat 100, thereby providing an open bow or stern with the inner surface of the bottom portion of cover 106 defining deck 114 as a floor surface in boat 100 (for example, a canoe). In some embodiments, the hybrid frame has a greater rigidity than cover 106. In some embodiments, cover 106 may include polyurethane tarpaulin or other materials, such as a layer of polyvinyl chloride (PVC) tarpaulin over a woven fabric, optionally with an extra laminate layer for additional abrasion resistance.

In one or more of the various embodiments, boat 100 may have forward end cap 118, aft end cap 120, one or more handles 122, one or more sealable deck openings 124 (for example, one or more zippable deck openings, hook-and-loop deck openings, or others), one or more deck hatches 126 (for example, one or more roll-top, hinged, or removable deck hatches that may be opened or closed with one or more zippers, hook-and-loop fasteners, rotational threading, or others), and one or more deck fittings 128 (for example, strap eyes, deck loops, or others) disposed in cover 106. In some of the various embodiments, each cockpit 112 may include one or more seats that have one or more seat bottoms 130 or one or more seat backs 132. In some embodiments, each cockpit 112 may include coaming 134 that facilitate retaining a spray skirt. In some embodiments, coaming 134 may be disposed on cover 106. For example, cover 106 may have lip 136 that at least partially surrounds cockpit 112, and coaming 134 may be disposed on lip 136. In some embodiments, coaming 134 may be separable from cover 106 (for example, hook-and-loop fasteners, zippers, or others), may be fixed to cover 106 (for example, stitching, fusing, or others), or may be integral to cover 106 (for example, an extension of cover 106). In some embodiments, coaming 134 may include an inflatable tube, a cover over the inflatable tube, one or more closeable accesses 138 (for example, a flap that separably couples to another portion of coaming 134 with one or more hook-and-loop fasteners, snaps, or others), and valve 140 to inflate or deflate the inflatable tube.

In other embodiments, coaming 134 may be rigid or molded and affixed (for example, glued, stitched, attached with hook-and-loop fasteners, or others) to cover 106. In some embodiments, coaming 134 may include one or more sections of rigid tubing that slide into one or more openings in one or more sleeves that are affixed (for example, glued, stitched, attached with hook-and-loop fasteners, or others) to cover 106 along one or more portions of lip 136. In some embodiments, the one or more openings may be disposed in one or more tops, inward-facing sides, outward-facing sides, or ends of one or more sleeves.

Figure 2:
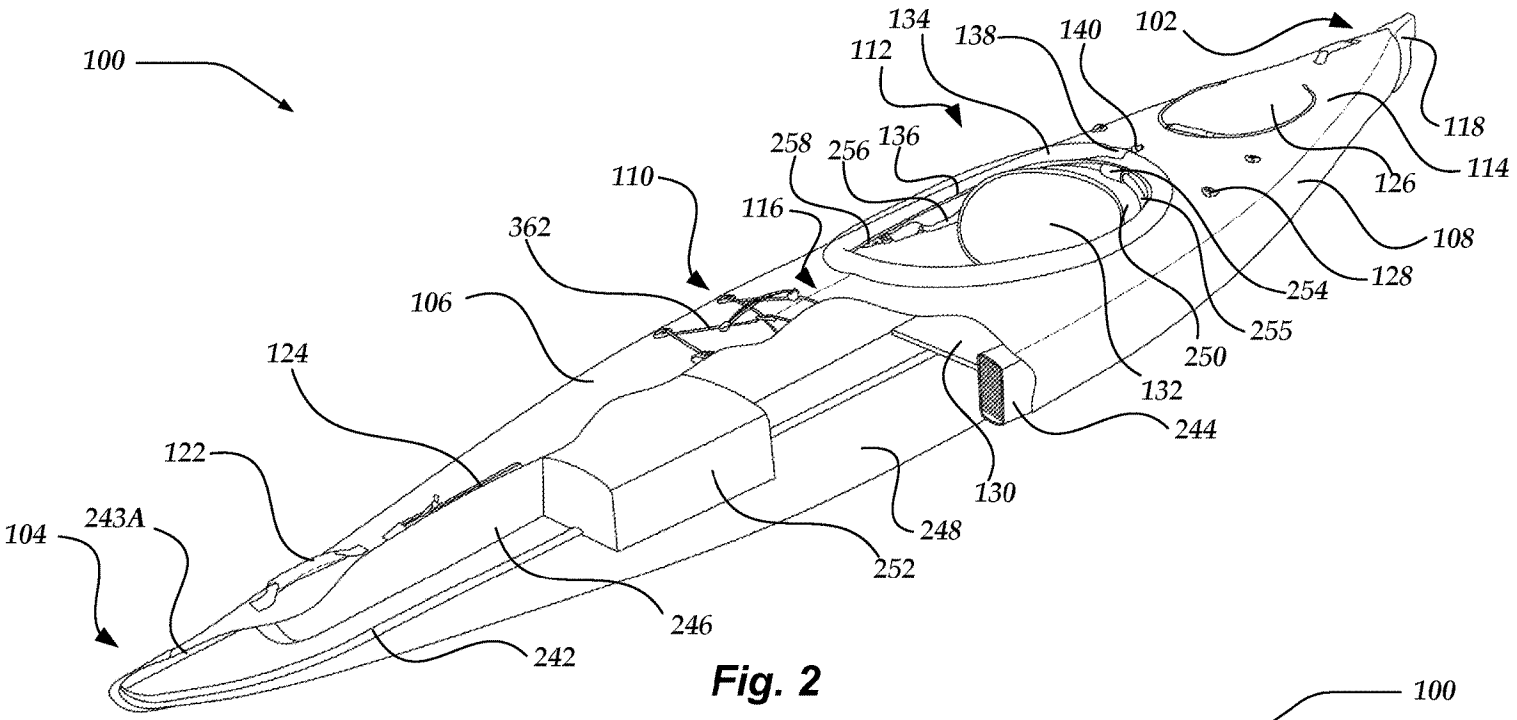
FIG. 2 shows a perspective front-left partial-cutaway view of the boat of FIG. 1, including a keel beam, bladders on opposite sides of the keel beam, and a forward thwart.
Figure 3:
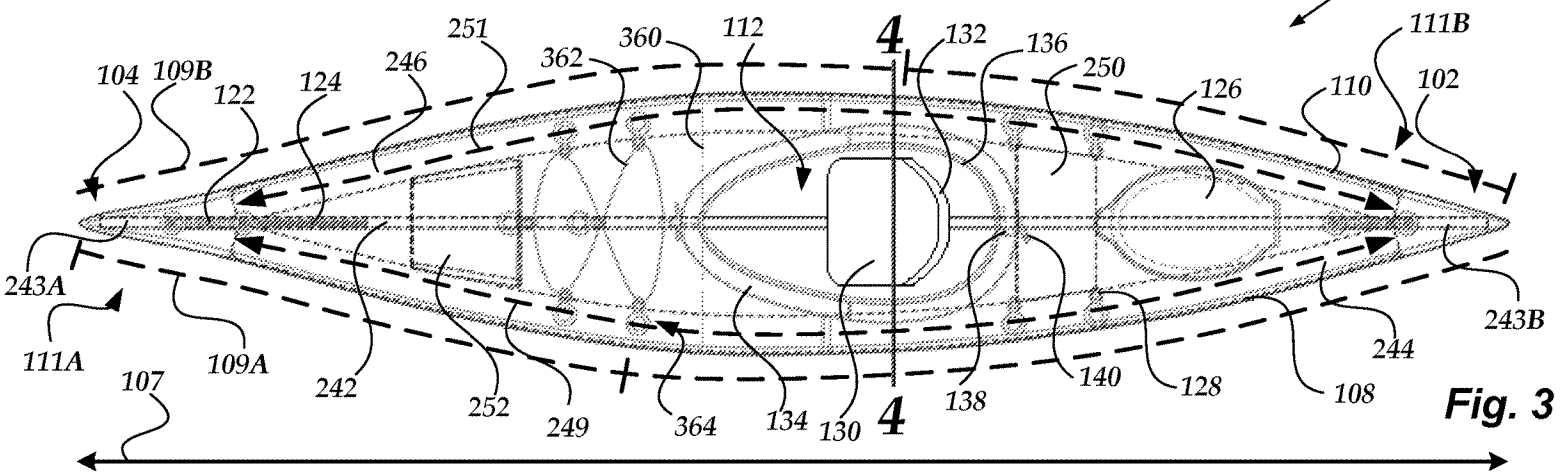
FIG. 3 illustrates a top view of the boat of FIG. 1, with hidden lines showing the keel beam, the bladders, the forward thwart, and an aft thwart.
Figures 4, 5, 6, 7:
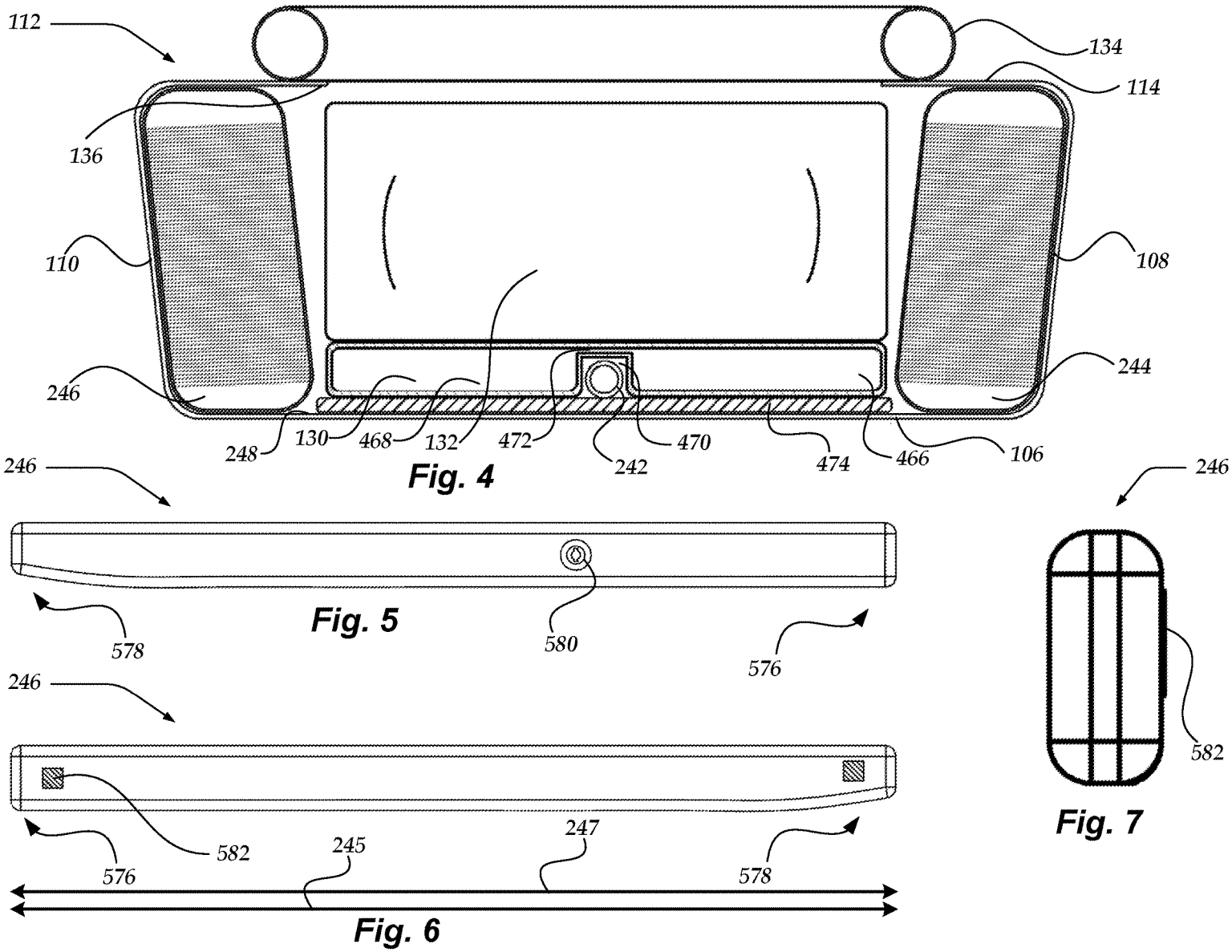
FIG. 4 shows a cross-sectional view of the boat of FIG. 1, taken across line 4-4 in FIG. 3.
FIG. 5 illustrates a schematic representation of an inner-side view of the right bladder of the boat of FIG. 1.
FIG. 6 shows a schematic representation of an outer-side view of the right bladder of the boat of FIG. 1.
FIG. 7 illustrates a rear view of the right bladder of the boat of FIG. 1.
Figure 11:
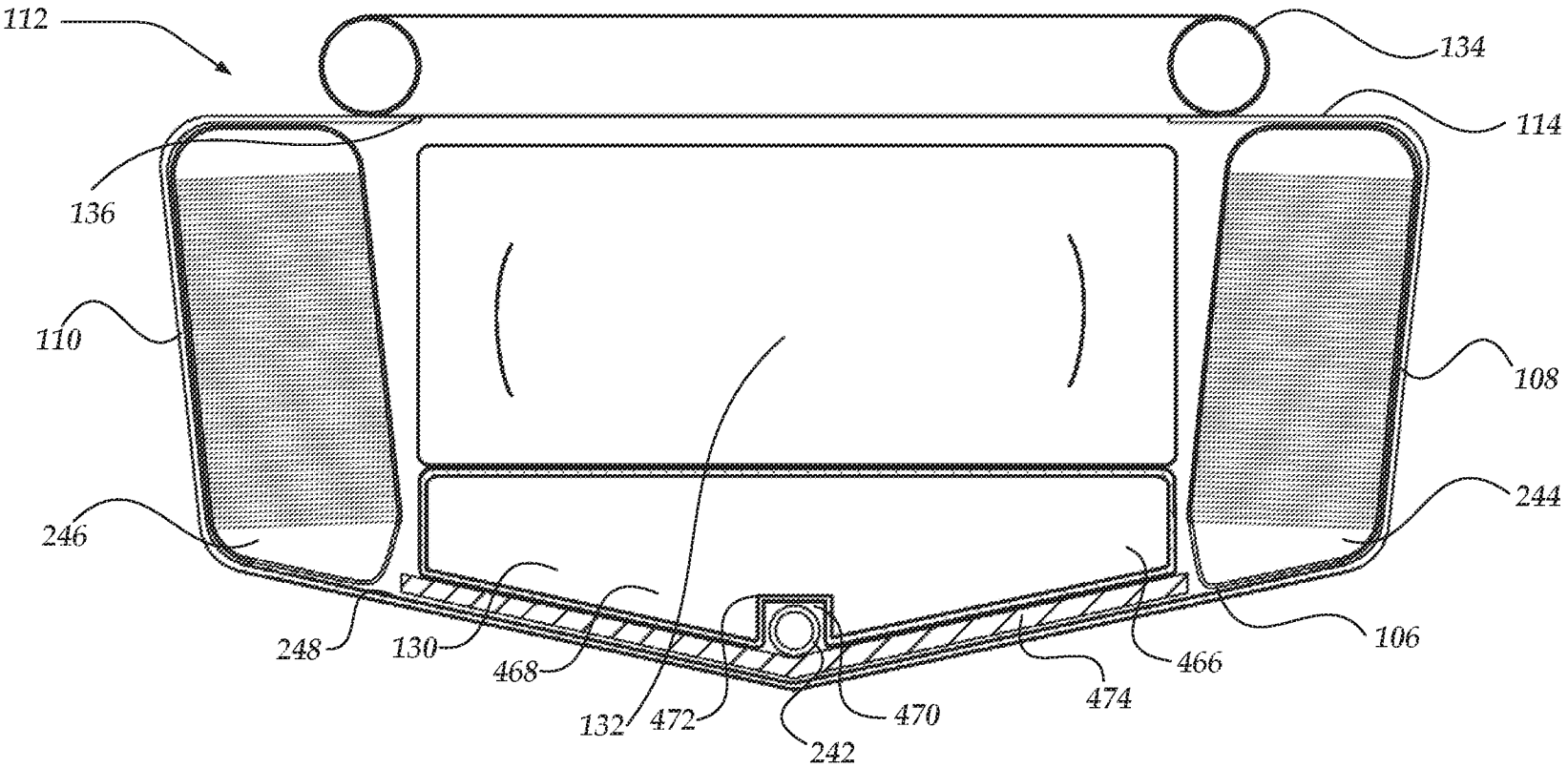
FIG. 11 illustrates another example cross-sectional view of the boat of FIG. 1, taken across line 4-4 in FIG. 3.

FIG. 2 shows a perspective front-left partial-cutaway view of boat 100, including portions of the hybrid frame. In one or more of the various embodiments, the hybrid frame may include keel beam 242, left (port) inflatable bladder 244 (having a longitudinal length 245 as best seen in FIG. 6 and preferably having a cross-section that has a shape with a width and with a height that exceeds the width of the shape as best seen in FIGS. 4 and 11), and right (starboard) inflatable bladder 246 (having a longitudinal length 247 as best seen in FIG. 6 and preferably having a cross-section that has a shape with a width and with a height that exceeds the width of the shape as best seen in FIGS. 4 and 11) disposed opposite keel beam 242 from left inflatable bladder 244. In some of the various embodiments, one or more of inflatable bladders 244, 246 may include one or more high-pressure inflatable bladders, such as bladders that may provide high levels of rigidity (for example, flexural rigidity, shear modulus, or others) when inflated to six, seven, eight, nine, ten, 11, 12, 13, 14, 15, 20, 25, or more pounds per square inch (PSI). For example, one or more of bladders 244, 246 may include one or more drop-stitch bladders with zigzag, diamond, random dot, or other internal face-to-face stitching/external dimpling, with or without treatment to facilitate employing higher PSI levels (for example, 15, 20, 25, or more PSI). In some embodiments, keel beam 242 may extend along at least a portion of the longitudinal length of boat 100. In some embodiments, keel beam 242 may include one or more plastics, rubbers, fiberglass, metals (for example, aluminum or others), or other materials.

In one or more of the various embodiments, keel beam 242 may extend along one or more portions of floor 248, thereby facilitating increasing rigidity of floor 248 or providing or retaining the shape of the hull of boat 100 (for example, a rounded, V-shaped, flat, pontoon, or other-shaped hull). In some of the various embodiments, keel beam 242 may be disposed in a center portion of floor 248. In some embodiments, boat 100 may have multiple keel beams 242 that are laterally separated from each other to define multiple hulls when boat 100 floats in water.

In one or more of the various embodiments, one or more portions of keel beam 242 (for example, one or more bow or stern deck-riser beams, such as bow deck-riser beam 243A or stern deck-riser beam 243B as best seen in FIGS. 2 and 3, that are coupled to or part of keel beam 242) may extend along one or more portions of deck 114 (for example, extending from one or more of aft end portion 102 or forward end portion 104 partially or entirely to cockpit 112) to facilitate increasing rigidity of deck 114 or providing ridge 116. In some of the various embodiments, keel beam 242 may have one or more bends or joints to provide one or more U-shaped or V-shaped curves in keel beam 242 at one or more of aft end portion 102 or forward end portion 104, thereby facilitating keel beam 242 extending along one or more portions of floor 248 and one or more portions of deck 114. In other embodiments, one or more deck-riser beams (for example, a bow deck-riser beam, a stern deck-riser beam, or others) that are separate or distinct from keel beam 242 may extend along one or more portions of deck 114 to facilitate increasing rigidity of deck 114. In some embodiments, keel beam 242 or the one or more deck-riser beams may include one or more socketed poles that are separable from each other, one or more telescoping sections, or other mechanisms for reducing size for storage or transportation. For example, one or more portions of keel beam 242 or the one or more deck-riser beams may include one or more locking sleeves that have threads, spring-loaded couplings, push-button couplings, or others to facilitate locking an end portion of a first separable socket pole to an end portion of another separable socket pole received in the end portion of the first separable socket pole.

In one or more of the various embodiments, one or more portions of keel beam 242 or one or more deck-riser beams may be disposed in the interior space of boat 100 defined by cover 106. In some of the various embodiments, one or more portions of keel beam 242 or the one or more deck-riser beams may be disposed on the exterior surface of boat 100. For example, one or more straps, bungee cords, hooks, loops, or others may extend from the interior or exterior surface of cover 106 and may wrap at least partially around keel beam 242 or the one or more deck-riser beams to secure keel beam 242 to cover 106. In some embodiments, one or more portions of keel beam 242 or the one or more deck-riser beams may be at least partially disposed in cover 106. For example, cover 106 may include multiple layers or one or more fabric tubes or sleeves, and keel beam 242 or the deck-riser beam may be positioned between two of the layers or in the one or more tubes, such as i) by sliding through an opening to the space between the layers or in the one or more tubes at an end or middle portion of boat 100, with the opening being accessible from the interior or exterior of cover 106, or ii) by opening the space with a hook-and-loop fastener, zipper, set of snaps, or other fasteners disposed along one or more portions of the longitudinal length of the space, with the opening being accessible from the interior or exterior of cover 106.

In one or more of the various embodiments, boat 100 may include one or more aft thwarts 250 or one or more forward thwarts 252 that apply lateral force to left and right bladders 244, 246, thereby facilitating bracing boat 100 crosswise. In some embodiments, a user may place gear in the interior space of boat 100 to provide one or more functions of one or more thwarts 250, 252. In some of the various embodiments, one or more thwarts 250, 252 may have heights (for example, fully-inflated heights when external to cover 106) that exceed the distance between floor 248 and deck 114 at the installation position of one or more thwarts 250, 252 when left and right bladders 244, 246 are inflated and before installation of thwarts 250, 252, thereby facilitating increasing rigidity of deck 114 or providing ridge 116. For example, the top face or the bottom face of one or more thwarts 250, 252 may have slopes that define the installed slope of one or more portions of keel beam 242 or the one or more deck-riser beams, thereby facilitating providing a predefined slope to deck 114 or floor 248.

In one or more of the various embodiments, one or more thwarts 250, 252 may be inflatable, foldable, or otherwise collapsible. In some of the various embodiments, one or more valves (for example, one or more twist valves, Boston valves, or others) may be disposed in one or more thwarts 250, 252 or in one or more hoses that fluidly couple the one or more valves to interior space in one or more thwarts 250, 252, such as valve 254 positioned in cockpit 112 and fluidly coupled via hose 255 to interior space in aft thwart 250. In some embodiments, one or more thwarts 250, 252 may have one or more elbow fittings (for example, one or more 90-degree elbows or others) disposed at one or more of the port or starboard side faces of one or more thwarts 250, 252 and that fluidly couple one or more hoses 255 to the interior space of one or more thwarts 250, 252. In some embodiments, one or more thwarts 250, 252 may have footprints that correspond to the dimensions of the interior space that one or more thwarts 250, 252 occupy when installed in boat 100. For example, as shown in FIG. 3, thwarts 250, 252 have trapezoidal-shaped footprints, with port side walls that abut the inner face of left bladder 244 and starboard side walls that abut the inner face of right bladder 246.

In one or more of the various embodiments, one or more straps 256 coupled to seatback 132 may be coupled to one or more clasps 258 (for example, one or more snap-fit buckles or others) that removably couple to cover 106, thereby facilitating supporting seatback 132 and adjustment of the position of seatback 132 relative to cover 106. In other embodiments, one or more straps 256 coupled to cover 106 may be coupled to one or more clasps 258 that removably couple to seatback 132.

FIG. 3 illustrates a top view of boat 100, with hidden lines showing portions of keel beam 242, left bladder 244, right bladder 246, aft thwart 250, and forward thwart 252. In one or more of the various embodiments, when inflated, one or more of left and right bladders 244, 246 may apply an outward lateral force to one or more of side walls 108, 110 of cover 106, thereby facilitating providing a taut configuration for cover 106 (in contrast to a relaxed configuration of cover 106 when the removable components of boat 100 are uninstalled from cover 106 or are sufficiently deflated or decoupled from cover 106). In some of the various embodiments, cover 106 in the taut configuration may have a shape that is narrower at one or more of the stern or the bow of boat 100 than the maximum width or beam 360 at a mid-ship portion of boat 100. Accordingly, in some embodiments, when left and right bladders 244, 246 are fully inflated in cover 106, left and right bladders 244, 246 may be in a bowed configuration with side walls 108, 110 of cover 106 along the entire longitudinal length of left and right bladders 244, 246 and with one or more of the aft and forward end portions of left and right bladders 244, 246 being closer to keel beam 242 than the middle portions of left and right bladders 244, 246. For example, one or more thwarts 250, 252 may apply an outward lateral force to one or more of left or right bladders 244, 246, thereby facilitating conforming the shape of one or more of left or right bladders 244, 246 to the shape of cover 106 (for example, the bowed configuration) and providing the taut configuration of cover 106. As another example, one or more of left or right bladders 244, 246 may have a longitudinal length that exceeds the longitudinal length of cover 106, thereby facilitating cover 106 and one or more of left or right bladders 244, 246 applying a longitudinal force against each other and forcing one or more of left or right bladders 244, 246 into the bowed configuration when fully inflated in cover 106. In some embodiments, one or more thwarts 250, 252 may have greater widths at the top end portions of one or more thwarts 250, 252 than at the bottom end portions of one or more thwarts 250, 252, thereby facilitating providing or retaining one or more hull flares along one or more portions of the longitudinal length of boat 100 (see FIGS. 4 and 11).

Figure 12:
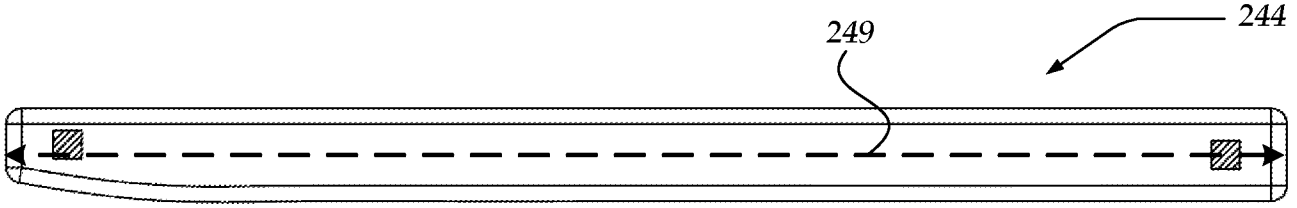
FIG. 12 shows a schematic representation of an outer-side view of the left bladder of the boat of FIG. 1.
Figure 13:
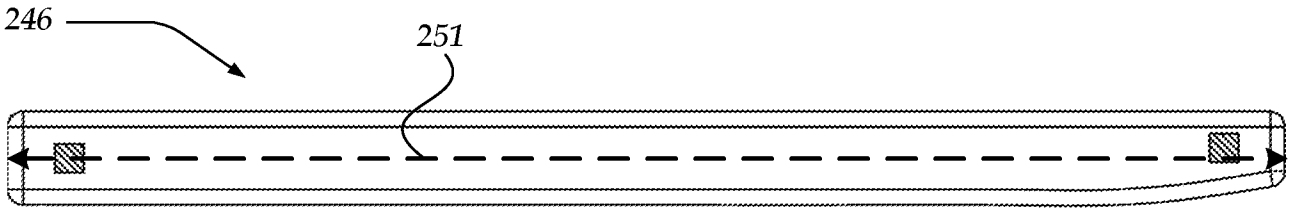
FIG. 13 illustrates a schematic representation of an outer-side view of the right bladder of the boat of FIG. 1.

In one or more of the various embodiments, one or more of left or right bladders 244, 246 may be in a straight configuration when fully inflated and in a resting state (for example, fully inflated external to cover 106). For example, as shown in FIGS. 12 and 13, one or more of the longitudinal axes 249, 251 of one or more of left or right bladders 244, 246 may follow a straight line (for example, parallel to the longitudinal length of cover 106 or parallel to keel beam 242) when one or more of left or right bladders 244, 246 are fully inflated external to cover 106 and are in the resting state (for example, no external lateral force applied to one or more of left or right bladders 244, 246). Accordingly, in some embodiments, the bowed configuration may be achieved based on the outward lateral force applied by one or more thwarts 250, 252 at the middle portion of one or more of left or right bladders 244, 246 and the inward lateral force applied by cover 106 at the aft and forward end portions of one or more of left or right bladders 244, 246. As shown in FIG. 3, one or more of the longitudinal axes 249, 251 of one or more of the drop-stitch port bladder 244 or the drop-stitch starboard bladder 246 preferably conform to corresponding one or more of the longitudinal contours 109A, 109B of the one or more of the port side or the starboard side of the cover 106 when the drop-stitch port bladder 244 and the drop-stitch starboard bladder 246 are fully inflated and installed in the cover 106 with one or more of the thwarts 250, 252 installed between the drop-stitch port bladder 244 and the drop-stitch starboard bladder 246.

In other embodiments, one or more of left or right bladders 244, 246 may be in the bowed configuration when fully inflated and in the resting state. For example, the inner side walls left and right bladders 244, 246 may have shorter longitudinal lengths than the outer side walls of left and right bladders 244, 246, thereby facilitating providing the bowed configuration when fully inflated in the resting state. As another example, a laminate may be applied with heat and glue to one or more sidewalls of one or more of left or right bladders 244, 246 to facilitate providing one or more curves along the longitudinal length of the one or more bladders 244, 246 that corresponds to the shape of cover 106. In some embodiments, one or more of the top or bottom faces of one or more of left or right bladders 244, 246 may be cut or shaped to promote the bowed configuration. In some embodiments, one or more of the top or bottom faces of one or more of left or right bladders 244, 246 may be bend or stretch to conform to the bowed configuration.

In one or more of the various embodiments, boat 100 may include one or more deck lines 362 that run through or otherwise couple to one or more deck fittings 128, thereby facilitating stowing gear on deck 114. In some of the various embodiments, one or more deck fittings 128 may be hingeably coupled to cover 106, thereby facilitating decreasing the likelihood that one or more deck fittings 128 break when stowed gear causes one or more deck lines 362 to apply one or more pulling forces on one or more deck fittings 128. In some embodiments, boat 100 may include one or more loops or anchors coupled to cover 106, and the one or more loops or anchors may be wrapped around one or more portions of one or more deck fittings 128, thereby facilitating the one or more deck fittings 128 swiveling or rotating relative to the one or more loops or anchors.

In one or more of the various embodiments, boat 100 may include one or more reinforcement members 364 (for example, one or more patches adhered, stitched, or otherwise secured to cover 106) that secure the one or more loops or anchors to cover 106. In some of the various embodiments, one or more reinforcement members 364 may be disposed in line (for example, in line from the perspective of an overhead view) with an expected force vector that is expected to be applied to one or more deck fittings 128 by one or more deck lines 362 when gear is stowed on deck 114. In some embodiments, one or more reinforcement members 364 may be disposed in cover 106 on the opposite sides of one or more deck fittings 128 than one or more locations toward which one or more deck fittings 128 are expected to be pulled when gear is stowed on deck 114. In the example shown in FIG. 3, each port-side deck fitting 128 has a reinforcement member 364 disposed to the port side of the base of the deck fitting because each port-side deck fitting 128 is expected to be pulled toward the starboard side of boat 100 when gear is stowed on deck 114. Conversely, in the example shown in FIG. 3, each starboard-side deck fitting 128 has a reinforcement member 364 disposed to the starboard side of the base of the deck fitting because each starboard-side deck fitting 128 is expected to be pulled toward the port side of boat 100 when gear is stowed on deck 114. Also in the example shown in FIG. 3, each central deck fitting 128 has a reinforcement member 364 disposed to the forward side of the base of the deck fitting because each central deck fitting 128 is expected to be pulled toward aft end portion 102 when gear is stowed on deck 114. In some embodiments, one or more reinforcement members 364 may couple one or more handles 122 to cover 106. For example, reinforcement members 364 may be disposed at opposite end portions of forward or aft handle 122 and may couple one or more straps or anchors of forward or aft handle 122 to cover 106.

In one or more of the various embodiments, one or more deck openings 124 or deck hatches 126 may provide access to the interior space in boat 100, such as the interior space forward or aft of one or more thwarts 250, 252, thereby facilitating storing gear in the interior space, installing one or more thwarts 250, 252, positioning or anchoring one or more bladders 244, 246, installing or adjusting the position of one or more thwarts 250, 252, or accessing one or more valves to inflate or deflate one or more portions of boat 100. In some of the various embodiments, a user may i) partially deflate one or more thwarts 250, 252, ii) reach through one or more deck openings 124, deck hatches 126, or cockpits 126 to grab one or more partially deflated thwarts 250, 252, iii) reposition the one or more partially deflated thwarts 250, 252, and iv) inflate one or more repositioned thwarts 250, 252. In some embodiments, one or more deck openings 124 or deck hatches 126 may provide access to one or more containers in boat 100.

FIG. 4 shows a cross-sectional view of boat 100, taken across line 4-4 in FIG. 3. In one or more of the various embodiments, one or more seat bottoms 130 may include one or more left (port) support portions 466, right (starboard) support portions 468, and passages 470 disposed between left and right support portions 466, 468 and extending along the entire longitudinal length of each seat bottom 130. In some of the various embodiments, left and right support portions 466, 468 may have heights that meet or exceed the height of keel beam 242. In some embodiments, passage 470 has a width that meets or exceeds the width of keel beam 242, with keel beam 242 extending through passage 470. In some embodiments, each seat bottom 130 may also include one or more bridge portions 472 disposed between or coupling left and right support portions 466, 468 above passage 470. Accordingly, seat bottom 130 may be disposed over keel beam 242 while maintaining a low center of gravity and without sacrificing comfort of a user. In some embodiments, one or more of seat bottom 130 and seat back 132 are inflatable. In some embodiments, the interior space of seat bottom 130 may be fluidly coupled to or fluidly isolated from the interior space of seat back 132. In other embodiments, one or more of seat bottom 130 or seat back 132 may be filled, instead of hollow for inflation. For example, one or more of seat bottom 130 or seat back 132 may include closed-cell foam.

In one or more of the various embodiments, boat 100 may include one or more floor pads 474 removably disposed between one or more portions of floor 248 and one or more elements above floor 248, such as keel beam 242, seat bottom 130, or others, thereby facilitating reducing the likelihood of puncturing cover 106. In some of the various embodiments, floor pad 474 may have a longitudinal length that meets or exceeds the longitudinal length of seat bottom 130, such as a longitudinal length of 1.5, 2, 2.5, 3, 3.5, or 4 times the longitudinal length of seat bottom 130. In some embodiments, floor pad 474 may have a width that corresponds to the width of seat bottom 130 or the lateral distance between the inner faces of the left and right bladders 244, 246 at the longitudinal position floor pad 474, such as a width that is 25, 50, 75, 80, 85, 90, 95, 100, 105, 110, 115, 120, 125, or more percent of the width of seat bottom 130 or the lateral distance between the inner faces of the left and right bladders 244, 246 at the longitudinal position of floor pad 474. In some embodiments, floor pad 474 may include rubber, foam, plastic, or other materials.

In contrast to the flat hull bottom of FIG. 4, FIG. 11 shows an example of a V-shaped hull. In one or more of the various embodiments, one or more components of boat 100 may have one or more lower portions that have shapes that correspond to sloping floor 248 of the V-shaped hull. For example, one or more bladders 244, 246, seat bottoms 130, floor pad 474, or others may have greater heights near the central longitudinal axis of boat 100 and smaller heights near side walls 108, 110. In some of the various embodiments, one or more seat bottoms 130 may have an upper portion that is generally flat and a lower portion that corresponds to sloping floor 248, as shown in FIG. 11. In other embodiments, one or more floor pads 474 may have an upper portion that is generally flat and a lower portion that corresponds to sloping floor 248 with a passage through which keel beam 242 may extend (for example, a passage similar to passage 470 yet with the top of the passage being open instead of the bottom as with passage 470), thereby facilitating providing a generally flat surface on which one or more seat bottoms 130 may rest.

FIG. 5 illustrates an inner-side view of right bladder 246 of boat 100. FIG. 6 shows an outer-side view of right bladder 246. FIG. 7 illustrates a rear view of right bladder 246. In one or more of the various embodiments, left bladder 244 is a mirror instance of right bladder 246. In some of the various embodiments, one or more bladders 244, 246 have aft end portions 576 and forward end portions 578. In some embodiments, one or more bladders 244, 246 may include one or more valves 580 (for example, one or more twist valves, Boston valves, or others) disposed in one or more bladders 244, 246 (for example, in the inner face or other portions of one or more bladders 244, 246) or in one or more hoses that fluidly couple one or more valves 580 to interior space in one or more bladders 244, 246. In some embodiments, one or more bladders 244, 246 may include one or more anchor members 582 disposed in the outer face of one or more bladders 244, 246, such as one or more hook-and-loop fasteners, snaps, or others disposed at one or more aft end portions 576 or forward end portions 578 of one or more bladders 244, 246. In some embodiments, cover 106 may include one or more corresponding anchor members disposed at one or more positions in an internal face of one or more side walls 108, 110 that correspond to the positions of one or more anchor members 582 when one or more bladders 244, 246 are correctly installed, such as one or more aft or forward end portions of one or more side walls 108, 110. Accordingly, in some embodiments, anchor members 582 and the corresponding anchor members in cover 106 may facilitate retaining bladders 244, 246 at the correct installation positions.

In one or more of the various embodiments, one or more bladders 244, 246 may have a rectangular shape as viewed from aft or forward end portions 576, 578 (see FIG. 7), with the heights of one or more bladders 244, 246 exceeding the widths of one or more bladders 244, 246 along the majority of the longitudinal lengths of one or more bladders 244, 246. For example, the height may be 1.25, 1.5, 1.75, 2, 2.25, 2.5, 2.75, 3, or more times the width. In some of the various embodiments, one or more bladders 244, 246 may have widths of 3, 4, 5, 6, 7, 8, 9, ten, eleven, twelve, or fewer inches. In some embodiments, one or more bladders 244, 246 may have a smaller height at one or more aft or forward end portions 576, 578 than the other of aft or forward end portions 576, 578 or than the middle portion of one or more bladders 244, 246. For example, the bottom face of one or more bladders 244, 246 may slope upward along the longitudinal length of one or more bladders 244, 246 from a middle portion toward one or more end portions in the aft-most or forwardmost 5, 10, 15, 20, 25, 30, or more percent of one or more bladders 244, 246 (see FIGS. 5 and 6), thereby facilitating providing or retaining the stern or bow shape of boat 100 (for example, increasing rocker of the hull of boat 100, at least in comparison to the hull of boat 100 with a shallower or shorter upward slope of one or more bladders 244, 246).

Figure 8:
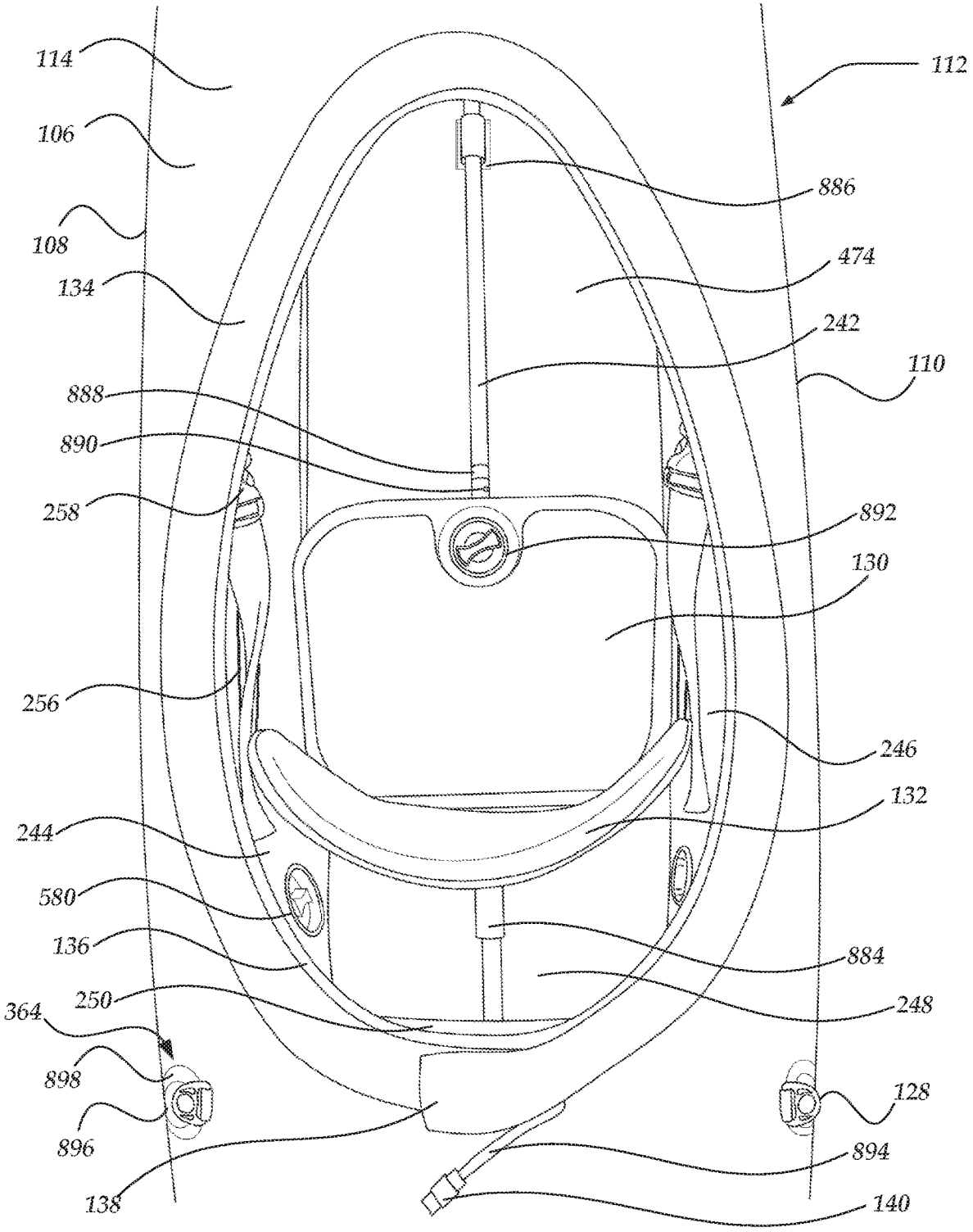
FIG. 8 shows a top view of a cockpit of the boat of FIG. 1.

FIG. 8 shows an overhead view of cockpit 112 of boat 100. In one or more of the various embodiments, one or more retainers 884 may secure keel beam 242 and cover 106 to each other. In some of the various embodiments, floor pad 474 may include one or more apertures 886 that are sized, dimensioned, and positioned to receive one or more retainers 884 when floor pad 474 is installed in boat 100, thereby facilitating securing keel beam 242 and cover 106 to each other with floor pad 474 disposed between them and maintaining the installed position of floor pad 474. In some embodiments, one or more retainers 884 may include one or more hooks, loops with one or more fasteners (for example, one or more hook-and-loop fasteners, snaps, or others), sleeves, clamps, or others.

In one or more of the various embodiments, keel beam 242 may have multiple sections. In some of the various embodiments, keel beam 242 may include one or more joints 888 where each section of keel beam 242 meets another section of keel beam 242. In some embodiments, the sections are separable from each other. In some embodiments, keel beam 242 may include one or more locks 890 that facilitate securing two or more sections to each other. For example, FIG. 8 shows lock 890 as including a push-button dome head in one section that inserts into another section, with the push-button dome head extending through an aperture in the other section, thereby facilitate securing the inserted section to the other section until the push-button dome head is depressed back into the aperture and the inserted section is pulled away from the aperture.

In one or more of the various embodiments, one or more seat bottoms 130 or seat backs 132 may include one or more inflatable portions and one or more valves 892 (for example, one or more twist valves, Boston valves, or others) to inflate or deflate the one or more inflatable portions. In some of the various embodiments, the interior space in seat bottom 130 may be fluidly coupled to the interior space in seat back 132. In some embodiments, the interior space in seat bottom 130 may be fluidly isolated from the interior space in seat back 132. In some embodiments, valve 140 may be disposed in hose 894 that fluidly couples valve 140 to interior space in one or more inflatable tubes in coaming 134.

In one or more of the various embodiments, one or more reinforcement members 364 that secure one or more loops or anchors at one or more bases of one or more handles 122, deck fittings 128, or others may include one or more inner reinforcement members 896 and one or more outer reinforcement members 898. In some of the various embodiments, one or more inner reinforcement members 896 may be disposed over the one or more loops or anchors and may be adhered, stitched, or otherwise secured to cover 106. In some embodiments, one or more outer reinforcement members 898 may be disposed over one or more inner reinforcement members 898 and may be adhered, stitched, or otherwise secured to cover 106. In some embodiments, one or more inner or outer reinforcement members 896, 898 may include one or more patches of one or more materials, such as one or more materials that are the same as or different than one or more materials in cover 106.

Figure 10:
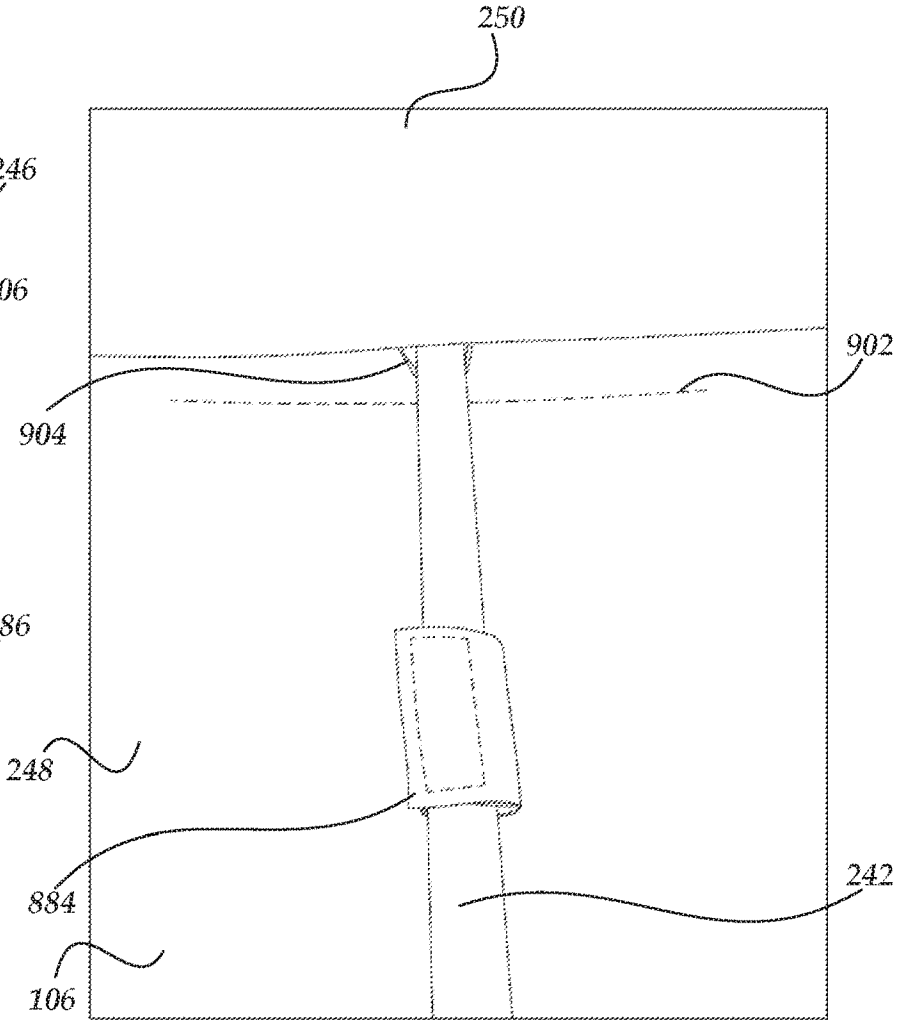
FIG. 10 shows a rearward view from the interior of the cockpit of the boat of FIG. 1.
Figure 9:
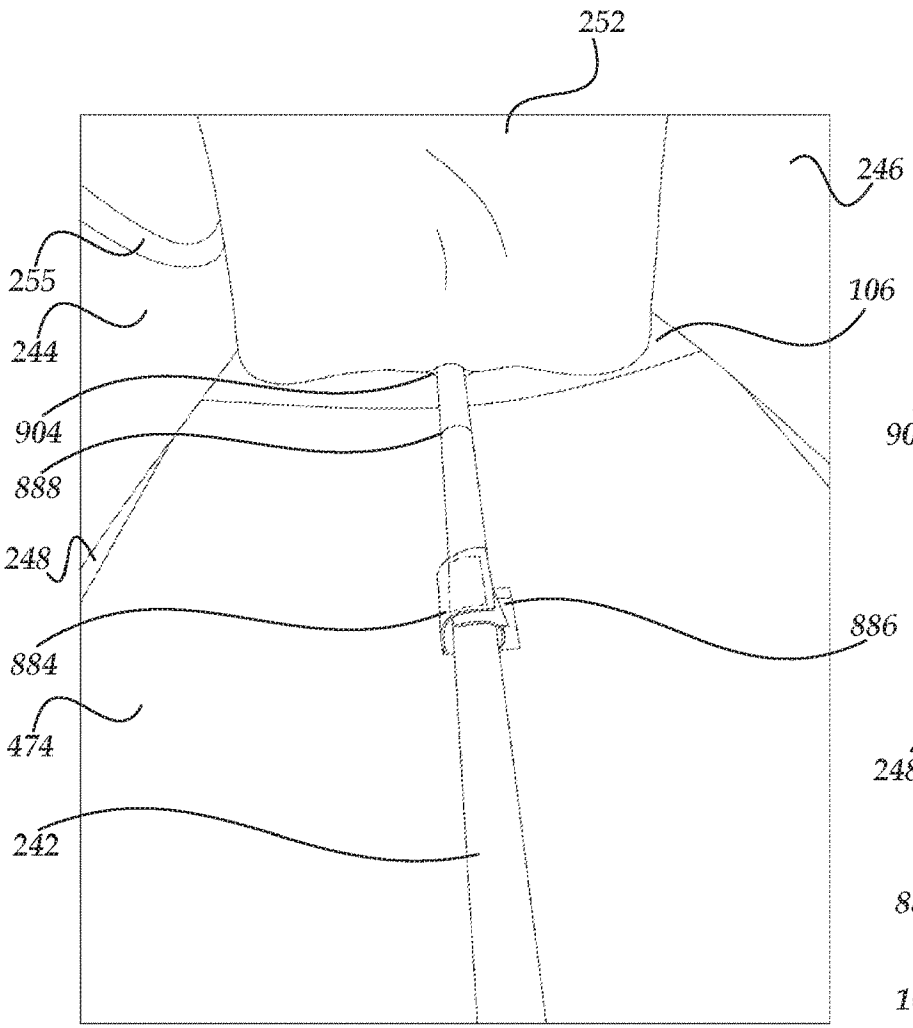
FIG. 9 illustrates a forward view from an interior of the cockpit of the boat of FIG. 1.

FIG. 9 illustrates a forward view from the interior of cockpit 112 of boat 100. FIG. 10 shows a rearward view from the interior of cockpit 112. In one or more of the various embodiments, one or more thwarts 250, 252 may have one or more hoses 255 that fluidly couple the one or more valves of one or more thwarts 250, 252 to interior space in one or more thwarts 250, 252, thereby facilitating inflating or deflating one or more thwarts 250, 252 that have been positioned at the installation position. In some of the various embodiments, one or more thwarts 250, 252 may have one or more strain reliefs or other protective mechanisms (for example, one or more elbows) disposed at the face of one or more thwarts 250, 252 where one or more hoses 255 connect. In some embodiments, floor 248 may include one or more installation markings 902 (for example, one or more silk-screened markings or others) that indicate the installation position of one or more thwarts 250, 252. In some embodiments, one or more thwarts 250, 252 may include one or more retainers 904 disposed in the bottom face of one or more thwarts 250, 252, such as one or more hooks, tubes or sleeves, loops with or without one or more fasteners (for example, one or more hook-and-loop fasteners, snaps, or others), clamps, or others that partially or entirely circumferentially surround keel beam 242. In some embodiments, one or more retainers 904 may slidably secure keel beam 242 and one or more thwarts 250, 252 to each other.

In one or more of the various embodiments, when disassembling boat 100, a user may deflate one or more inflatable components, such as one or more of seat bottom 130, seat back 132, left bladder 244, right bladder 246, aft thwart 250, forward thwart 252, or others to provide the relaxed configuration of cover 106. In some of the various embodiments, after at least partially deflating the one or more components, the user may remove one or more of the removable components of boat 100 from cover 106 for storage or transportation, such as one or more of seat bottom 130, seat back 132, keel beam 242, bow or stern deck-riser beams, left bladder 244, right bladder 246, floor pad 474, or others. In some embodiments, when the removable components of boat 100 are installed in cover and the inflatable components are fully inflated (for example, cover 106 in the taut configuration), boat 100 may have a length of five, six, or fewer feet (for example, play boats or others), a length of seven, eight, or fewer feet (for example, whitewater kayaks or others), a length of nine, 10, 11, 12, 13, 14 or more feet (for example, recreational kayaks or others), a length of 15, 16, 17, 18, 19, or more feet (for example, touring kayaks, sea kayaks, or others), or other lengths. In some embodiments, when the removable components of boat 100 are installed in cover and the inflatable components are fully inflated (for example, cover 106 in the taut configuration), boat 100 may have a width of 20, 22, 24, 26, 28, 30, or more inches. In some embodiments, when the inflatable components are deflated and boat 100 is disassembled and folded for transportation or storage, boat 100 may have a folded size of 35 inches by 21 inches by 9 inches.

The foregoing examples should not be construed as limiting or exhaustive, yet rather, illustrative use cases to show implementations of at least one of the various embodiments of the invention. Accordingly, many changes can be made without departing from the spirit and scope of the invention. For example, changes to the example implementation illustrated in FIG. 1 may include a second or third cockpit 112, one or more tracking fins extending from the underside of floor 248, one or more landing plates disposed in the underside of floor 248, one or more foot braces in the interior space of boat 100, one or more rudders disposed at aft end portion 102 and one or more corresponding rudder pedals disposed in the interior space of boat 100, one or more thigh braces disposed in the interior space of boat 100, or others. As another example, although side walls 108, 110 of boat 100 are shown in FIG. 2 as being without beams or further supports beyond bladders 244, 246, some embodiments of boat 100 may include further supports such as one or more ribs (for example, one or more bow ribs or stern ribs) that extend along one or more side walls 108, 110 of boat 100 and that are removably or non-removably coupled to cover 106. As a further example, although floor 248 is shown as lacking floor bladders or further supports beyond one or more keel beams 242 and left and right bladders 244, 246, some embodiments of boat 100 may include one or more floor bladders (for example, one or more inflatable drop-stitch floors) or crosswise ribs that are removably or non-removably coupled to cover 106. Thus, the scope of the invention is not limited by the disclosure of the examples. Instead, the invention should be determined entirely by reference to the claims that follow.

The embodiments of the invention in which an exclusive property or privilege is claimed are defined as follows:

1. A hybrid frame boat, comprising:

a cover having an aft end portion, a forward end portion, a port side, a starboard side, a longitudinal length extending from the aft end portion to the forward end portion;

a drop-stitch port bladder removably coupled to the cover, the drop-stitch port bladder extending along one or more portions of the port side of the cover;

a drop-stitch starboard bladder removably coupled to the cover, the drop-stitch starboard bladder extending along one or more portions of the starboard side of the cover; and a keel beam removably coupled to the cover, the keel beam extending along one or more portions of the longitudinal length of the cover between the drop-stitch port bladder and the drop-stitch starboard bladder, wherein one or more of the drop-stitch port bladder or the drop-stitch starboard bladder have an aft end portion, a forward end portion, a longitudinal length extending from the aft end portion of the one or more of the drop-stitch port bladder or the drop-stitch starboard bladder to the forward end portion of the one or more of the drop-stitch port bladder or the drop-stitch starboard bladder, a top face, and a bottom face that, when the one or more of the drop-stitch port bladder or the drop-stitch starboard bladder is fully inflated external to the cover, slopes upward relative to the top face of the one or more drop-stitch bladders along one or more portions of the longitudinal length of the one or more bladders from a middle portion of the one or more drop-stitch bladders toward one or more of the aft end portion of the one or more drop-stitch bladders or the forward end-portion of the one or more bladders.

2. The hybrid frame boat of claim 1, wherein the cover has an exterior bottom surface that, when the drop-stitch port bladder and the drop-stitch starboard bladder are fully inflated and installed in the cover with the keel beam, forms a V-hull.

3. The hybrid frame boat of claim 1, wherein one or more of the drop-stitch port bladder or the drop-stitch starboard bladder have a cross-section that is transverse to the longitudinal length of the cover, the cross-section having a shape with a width, the shape of the cross-section having a height that exceeds the width of the shape.

4. The hybrid frame boat of claim 1, wherein the cover has an interior top surface and an interior bottom surface, and one or more of the drop-stitch port bladder or the drop-stitch starboard bladder has, when fully inflated and installed in the cover, a height that extends from the interior bottom surface of the cover to the interior top surface of the cover.

5. The hybrid frame boat of claim 1, further comprising a thwart removably disposed above the keel beam, wherein:

each of the port side and the starboard side of the cover has a longitudinal contour that has one or more portions that are transverse to the longitudinal length of the cover;

one or more of the drop-stitch port bladder or the drop-stitch starboard bladder have a longitudinal axis, the longitudinal axis of the one or more of the drop-stitch port bladder or the drop-stitch starboard bladder being parallel to the longitudinal length of the cover when the one or more of the drop-stitch port bladder or the drop-stitch starboard bladder are fully inflated external to the cover; and the thwart has a width that extends from the drop-stitch port bladder to the drop-stitch starboard bladder when the drop-stitch port bladder and the drop-stitch starboard bladder are fully inflated and installed in the cover, the longitudinal axis of the one or more of the drop-stitch port bladder or the drop-stitch starboard bladder conforming to the longitudinal contour of one or more of the port side or the starboard side of the cover when the drop-stitch port bladder and the drop-stitch starboard bladder are fully inflated and installed in the cover with the thwart installed between the drop-stitch port bladder and the drop-stitch starboard bladder.

6. The hybrid frame boat of claim 1, wherein each of the port side and the starboard side of the cover has a longitudinal contour that has one or more portions that are transverse to the longitudinal length of the cover, one or more of the drop-stitch port bladder or the drop-stitch starboard bladder have a longitudinal axis, the longitudinal axis of the one or more of the drop-stitch port bladder or the drop-stitch starboard bladder being parallel to the longitudinal contour of one or more of the port side or the starboard side of the cover when the one or more of the drop-stitch port bladder or the drop-stitch starboard bladder are fully inflated external to the cover.

7. The hybrid frame boat of claim 1, wherein the cover has a relaxed configuration and a taut configuration, the cover being in the relaxed configuration when the drop-stitch port bladder, the drop-stitch starboard bladder, and the keel beam are removed from the cover, the cover being in the taut configuration when keel beam is installed in the cover and the drop-stitch port bladder and the drop-stitch starboard bladder are fully inflated and installed in the cover with the drop-stitch port bladder and the drop-stitch starboard bladder applying an outward lateral force to the port side and the starboard side of the cover.

8. The hybrid frame boat of claim 1, wherein the cover has a floor, the floor lacking floor bladders or further supports beyond the keel beam, the drop-stitch port bladder, and the drop-stitch starboard bladder.

9. The hybrid frame boat of claim 1, further comprising a deck-riser beam removably coupled to the cover, the deck-riser beam extending along one or more portions of the longitudinal length of the cover between the drop-stitch port bladder and the drop-stitch starboard bladder.

10. The hybrid frame boat of claim 1, wherein the cover has a port side wall and a starboard side wall, one or more of the port side wall of the cover or the starboard side wall of the cover being devoid of beams beyond the drop-stitch port bladder or the drop-stitch starboard bladder.

11. A method of assembling a hybrid frame boat, comprising:

unfolding a cover having an aft end portion, a forward end portion, a port side, a starboard side, a longitudinal length extending from the aft end portion to the forward end portion;

removably coupling a drop-stitch port bladder to the cover, the drop-stitch port bladder extending along one or more portions of the port side of the cover;

removably coupling a drop-stitch starboard bladder to the cover, the drop-stitch starboard bladder extending along one or more portions of the starboard side of the cover;

removably coupling a keel beam to the cover, the keel beam extending along one or more portions of the longitudinal length of the cover between the drop-stitch port bladder and the drop-stitch starboard bladder; and inflating the drop-stitch port bladder and the drop-stitch starboard bladder, wherein one or more of the drop-stitch port bladder or the drop-stitch starboard bladder have an aft end portion, a forward end portion, a longitudinal length extending from the aft end portion of the one or more of the drop-stitch port bladder or the drop-stitch starboard bladder to the forward end portion of the one or more of the drop-stitch port bladder or the drop-stitch starboard bladder, a top face, and a bottom face that, when the one or more of the drop-stitch port bladder or the drop-stitch starboard bladder is fully inflated external to the cover, slopes upward relative to the top face of the one or more drop-stitch bladders along one or more portions of the longitudinal length of the one or more bladders from a middle portion of the one or more drop-stitch bladders toward one or more of the aft end portion of the one or more drop-stitch bladders or the forward end-portion of the one or more bladders.

12. The method of claim 11, wherein inflating the drop-stitch port bladder and the drop-stitch starboard bladder comprises fully inflating the drop-stitch port bladder and the drop-stitch starboard bladder when the drop-stitch port bladder and the drop-stitch starboard bladder are installed in the cover with the keel beam, wherein the cover has an exterior bottom surface that, when the drop-stitch port bladder and the drop-stitch starboard bladder are fully inflated and installed in the cover with the keel beam, forms a V-hull.

13. The method of claim 11, wherein one or more of the drop-stitch port bladder or the drop-stitch starboard bladder have a cross-section that is transverse to the longitudinal length of the cover, the cross-section having a shape with a width, the shape of the cross-section having a height that exceeds the width of the shape.

14. The method of claim 11, wherein the cover has an interior top surface and an interior bottom surface, and one or more of the drop-stitch port bladder or the drop-stitch starboard bladder has, when fully inflated and installed in the cover, a height that extends from the interior bottom surface of the cover to the interior top surface of the cover.

15. The method of claim 11, further comprising removably disposing a thwart above the keel beam, wherein:

each of the port side and the starboard side of the cover has a longitudinal contour that has one or more portions that are transverse to the longitudinal length of the cover;

one or more of the drop-stitch port bladder or the drop-stitch starboard bladder have a longitudinal axis, the longitudinal axis of the one or more of the drop-stitch port bladder or the drop-stitch starboard bladder being parallel to the longitudinal length of the cover when the one or more of the drop-stitch port bladder or the drop-stitch starboard bladder are fully inflated external to the cover; and the thwart has a width that extends from the drop-stitch port bladder to the drop-stitch starboard bladder when the drop-stitch port bladder and the drop-stitch starboard bladder are fully inflated and installed in the cover, the longitudinal axis of the one or more of the drop-stitch port bladder or the drop-stitch starboard bladder conforming to the longitudinal contour of one or more of the port side or the starboard side of the cover when the drop-stitch port bladder and the drop-stitch starboard bladder are fully inflated and installed in the cover with the thwart installed between the drop-stitch port bladder and the drop-stitch starboard bladder.

16. The method of claim 11, wherein each of the port side and the starboard side of the cover has a longitudinal contour that has one or more portions that are transverse to the longitudinal length of the cover, one or more of the drop-stitch port bladder or the drop-stitch starboard bladder have a longitudinal axis, the longitudinal axis of the one or more of the drop-stitch port bladder or the drop-stitch starboard bladder being parallel to the longitudinal contour of one or more of the port side or the starboard side of the cover when the one or more of the drop-stitch port bladder or the drop-stitch starboard bladder are fully inflated external to the cover.

17. The method of claim 11, wherein the cover has a relaxed configuration and a taut configuration, the cover being in the relaxed configuration when the drop-stitch port bladder, the drop-stitch starboard bladder, and the keel beam are removed from the cover, the cover being in the taut configuration when keel beam is installed in the cover and the drop-stitch port bladder and the drop-stitch starboard bladder are fully inflated and installed in the cover with the drop-stitch port bladder and the drop-stitch starboard bladder applying an outward lateral force to the port side and the starboard side of the cover.

18. The method of claim 11, wherein the cover has a floor, the floor lacking floor bladders or further supports beyond the keel beam, the drop-stitch port bladder, and the drop-stitch starboard bladder.

19. The method of claim 11, further comprising removably coupling a deck-riser beam to the cover, the deck-riser beam extending along one or more portions of the longitudinal length of the cover between the drop-stitch port bladder and the drop-stitch starboard bladder.

20. The method of claim 11, wherein the cover has floor, a port side wall, and a starboard side wall, one or more of the port side wall of the cover or the starboard side wall of the cover being devoid of beams beyond the drop-stitch port bladder or the drop-stitch starboard bladder, the floor lacking floor bladders beyond the keel beam, the drop-stitch port bladder, and the drop-stitch starboard bladder.

* * * * *